United States Patent [19]

Calvert

[11] Patent Number: 4,533,047

[45] Date of Patent: Aug. 6, 1985

[54] HEEL RETAINING STRUCTURE ON BOTTLE CARRIER

[75] Inventor: Rodney K. Calvert, Dunwoody, Ga.

[73] Assignee: The Mead Corporation, Dayton, Ohio

[21] Appl. No.: 636,579

[22] Filed: Aug. 1, 1984

[51] Int. Cl.[3] ..... B65D 71/00

[52] U.S. Cl. ..... 206/434; 206/427; 229/40

[58] Field of Search ..... 229/40; 206/427, 429, 206/434, 140, 145-161

[56] References Cited

U.S. PATENT DOCUMENTS

| | | | |
|---|---|---|---|
| 3,142,378 | 7/1964 | Lengsfield, Jr. | 229/40 X |
| 3,229,892 | 1/1966 | Weiss | 229/40 |
| 3,367,557 | 2/1968 | Farquhar | 229/40 |
| 3,495,704 | 2/1970 | Richards et al. | 229/40 X |
| 3,517,876 | 6/1970 | Stout | 229/40 |
| 4,101,069 | 7/1978 | Wood | 229/40 |
| 4,330,079 | 5/1982 | Wood | 229/40 |
| 4,373,630 | 2/1983 | Oliff | 229/40 X |
| 4,382,505 | 5/1983 | Sutherland et al. | 206/427 X |

FOREIGN PATENT DOCUMENTS

| | | | |
|---|---|---|---|
| 24782 | 3/1981 | European Pat. Off. | 206/429 |

*Primary Examiner*—William Price
*Assistant Examiner*—Gary E. Elkins
*Attorney, Agent, or Firm*—Rodgers & Rodgers

[57] ABSTRACT

An economical mechanically strong bottle carrier of the wrap around type having top, bottom and side walls interconnected to form a tubular open ended structure is provided with bottle engaging and carrier reinforcing flaps which are associated with certain bottle heel receiving apertures at the carrier corners are arranged so as effectively to prevent dislodgment of the bottles from the open ended tubular structure and which in addition constiute significant reinforcement for the corners of the carrier so that the carrier formed of light weight paperboard is of sufficient mechanical strength whereby rupture of the carrier is prevented and secure retention of bottles is effected.

8 Claims, 4 Drawing Figures

HEEL RETAINING STRUCTURE ON BOTTLE CARRIER

TECHNICAL FIELD

This invention relates to bottle carriers of the wrap around type and is concerned with improved bottle retention carrier reinforcing structure associated with bottle heel receiving apertures disposed at certain corners of the carrier.

BACKGROUND ART

U.S. Pat. No. 3,517,876 issued June 30, 1970 and owned by the assignee of this invention discloses article carriers of the wraparound type which are provided with article engaging carrier reinforcing flaps associated with bottle heel receiving apertures located at the bottom corners of the carrier. The carrier reinforcing and bottle retaining flaps of this prior patent are especially well adapted for use in conjunction with tubular wrap around carriers having square corners.

DISCLOSURE OF THE INVENTION

According to this invention in one form, improved bottle engaging and carrier reinforcing flaps are provided which are especially well suited for use in conjunction with wrap around type carriers in which sloping heel panels are foldably joined to the bottom edges of the side walls and to the side edges of bottom lap panels which are secured together to form a tubular structure. The structure of this invention substantially enhances mechanical strength of the carrier and provides effective bottle retention while making possible a substantial reduction in the weight of material such as paperboard from which the carrier is formed. According to the invention each bottle heel receiving aperture at the bottom corners of the carrier is provided with a combination bottle engaging and carrier reinforcing flap which is foldably joined to the carrier along the outer edge of the associated heel receiving aperture so that each bottle engaging and carrier reinforcing flap is disposed astride the associated sloping heel panel and extends across adjacent parts of the associated side wall and lap panel, suitable fold lines being formed in each bottle retaining and carrier reinforcing flap so as to faciliate manipulation of the flap and to enhance its cooperation with the associated bottle. A second bottle engaging and reinforcing flap is associated with the corner bottle heel receiving apertures and is disposed opposite the flap which is disposed astride the sloping heel panel and which extends into the side wall and the bottom lap panel.

BRIEF DESCRIPTION OF THE DRAWINGS

In the drawings

FIG. 3 is a detailed fragmentary view taken along the line designated 3—3 in FIGS. 1 and 4 and in which

BEST MODE OF CARRING OUT THE INVENTION

Figure 2:
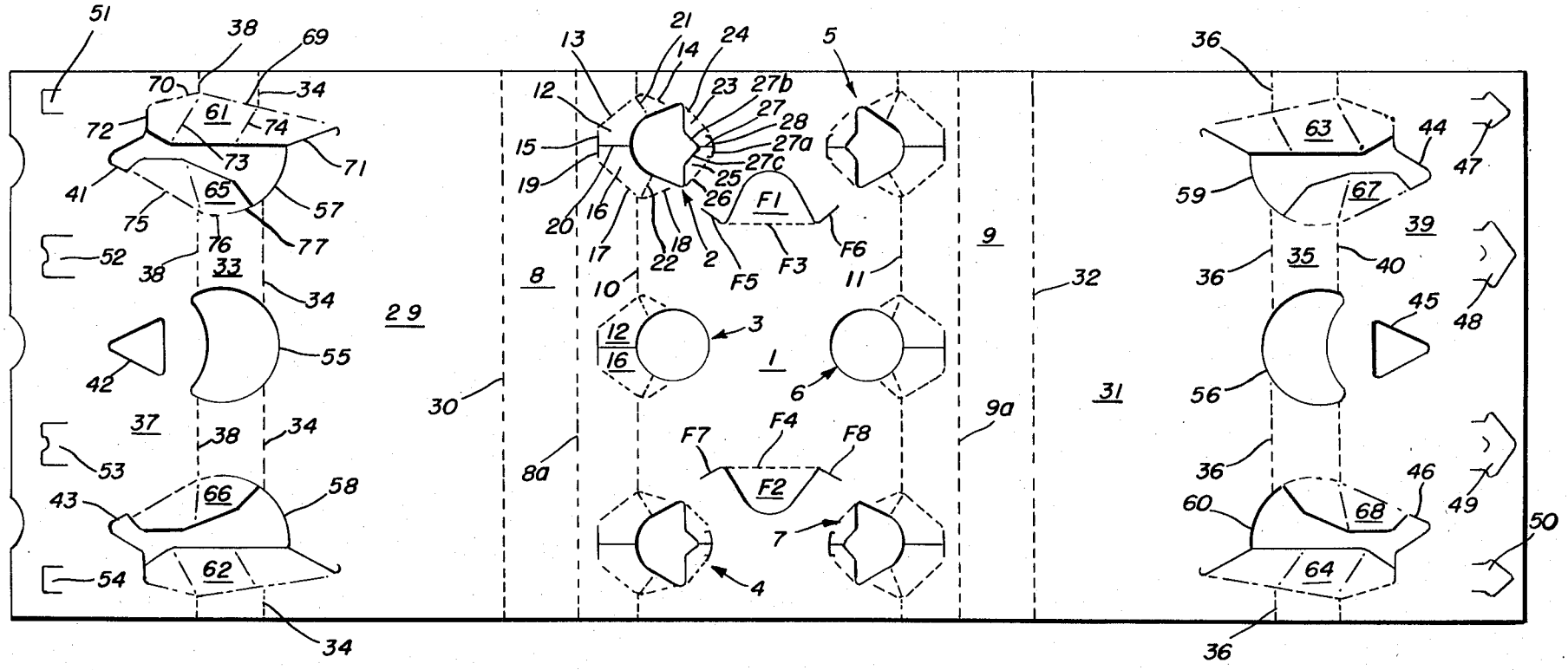
FIG. 2 is a plan view of a blank from which the carrier of FIG. 1 is formed.

The carrier blank as shown in FIG. 2 includes a top wall generally designated by the numeral 1 in which bottle neck receiving apertures 2–7 are formed. These apertures may extend somewhat into the sloping shoulder panels 8 and 9 which are foldably joined to the side edges of top wall 1 along fold lines 10 and 11 respectively. Fold lines 8*a* and 9*a* may be formed in sloping panels 8 and 9 respectively to adapt the wrapper to certain bottle shapes.

Finger gripping tabs F1 and F2 are struck from top wall 1 and are foldably joined thereto along fold lines F3 and F4 respectively. Slits F5 and F6 are angularly related to fold line F3 and slits F7 and F8 are similarly disposed relative to fold line F4.

Certain bottle neck engaging flaps are associated with the neck receiving apertures 2–7 as shown in FIG. 2. The flaps associated with apertures 2, 4, 5, and 7 are identical and for this reason the flaps associated with aperture 2 only will be described.

Flap 12 is foldably joined along fold line 13 to sloping shoulder panel 8 and to top wall 1 along fold line 14. Fold lines 13 and 14 intersect at fold line 10 by which sloping shoulder panel 8 is foldably joined to top wall 1. A slit 15 separates one end of the flap 12 from sloping shoulder panel 8 as is indicated. Tab 16 is complementary to tab 12 and includes fold lines 17 and 18 which intersect at fold line 10 and slit 19 separates an end of tab 16 as indicated from sloping shoulder panel 8. Tabs 12 and 16 are separated from each other by slit 20. Fold lines 21 and 22 facilitate bending of flaps 12 and 16 so as to facilitate engagement with the associated bottle neck.

On the other side of aperture 2 a small tab 23 is foldably joined to top wall 1 along fold line 24 while small tab 25 is foldably joined to top wall 1 along fold line 26. Tabs 23 and 25 are separated from each other along slit 27 one end of which coincides with slit 27*a* and the other end of which coincides with the intersection of angularly related edges 27*b* and 27*c* which form a V-shaped notch.

Apertures 2, 4, 5 and 7 and their associated flaps in a wrap around carrier form the subject matter of U.S. patent application Ser. No. 636,580 filed Aug. 1, 1984.

As is obvious from FIG. 2 tabs 12 and 16 are provided for aperture 3 but the small complementary tabs 23 and 25 are eliminated from bottle neck receiving apertures 3 and 6.

Side wall 29 is foldably joined to sloping shoulder panel 8 along fold line 30 while side wall 31 is foldably joined to sloping shoulder panel 9 along fold line 32.

Sloping heel panel 33 is foldably joined to the bottom edge of side wall 29 along interrupted fold line 34 while sloping heel panel 35 is foldably joined to the bottom edge of side wall 31 along interrupted fold line 36.

Bottom lap panel 37 is foldably joined to the bottom edge of sloping heel panel 33 along interrupted fold line 38 while bottom lap panel 39 is foldably joined to the bottom edge of sloping heel panel 35 along interrupted fold line 40.

For tightening the wrapper about a group of articles, tightening apertures 41, 42 and 43 are formed in lap panel 37 while similar tightening apertures 44, 45 and 46 are formed in lap panel 39. With the wrapper disposed about a group of articles and with the lap panels 37 and 39 disposed in overlapping relationship, machine elements enter the tightening apertures and move toward each other so as to tighten the wrapper about the group of articles as is well known.

After the wrapper is tightened, it is locked by means of locking tabs 47–50 which are driven through the apertures defined by retaining tabs 51–54 respectively. The configurations of the locking and retaining tabs are well known and the locking operation is well understood.

Conventional bottle heel receiving apertures 55 and 56 are disposed astride the heel sloping panels 33 and 35 respectively as shown in FIG. 2.

Bottle heel receiving apertures 57 and 58 are disposed astride the sloping heel panel 33 and extend into adjacent portions of side wall 29 and of lap panel 37 as is shown in FIG. 2. The tightening aperture 41 constitutes an extension of bottle heel receiving aperture 57 while tightening aperture 43 constitutes an extension of bottle heel receiving aperture 58.

In like fashion bottle heel receiving aperture 59 as well as bottle heel receiving aperture 60 are disposed astride the sloping heel panel 35 and extend into the lower portions of side wall 31 and into the adjacent portions of lap panel 39. Tightening aperture 44 constitutes an extension of bottle heel receiving aperture 59 while tightening aperture 46 constitutes an extension of bottle heel receiving aperture 60.

Bottle engaging carrier reinforcing flaps 61–68 are formed in accordance with this invention. Flaps 61–64 are identical and a detailed description of flap 61 only is here included. Similarly flaps 65–68 are identical and a description of flap 65 only is herein included.

Bottle engaging carrier reinforcing flap 61 is struck from sloping panel 33 and from side wall 29 and lap panel 33 and is foldably joined to the carrier along fold lines 69 and 70 which are angularly related and which intersect at fold line 38. A slit 71 separates one end of flap 61 from side wall 29 while a slit 72 separates the other end of flap 61 from lap panel 37.

For facilitating manipulation of the wrapper about an article group and to enhance the cooperation of the flap 61 with the associated bottle, a fold line 73 is formed in flap 61 one end of which coincides with the fold line 38. Similarly a fold line 74 is formed in flap 61 and is disposed in substantially parallel relation with the fold line 73 although these lines may not be precisely parallel with each other.

When the carrier is assembled with the flap 61 in engagement with an associated bottle, the fold line 73 is disposed adjacent to and lies in a plane which is in substantially parallel relation with the lap panel 37.

Bottle engaging and carrier reinforcing flap 65 is foldably joined to lap panel 37 along fold line 75 and to sloping heel panel 33 along fold line 76. A slit 77 separates a curved end portion of flap 65 from sloping heel panel 33.

Figure 1:
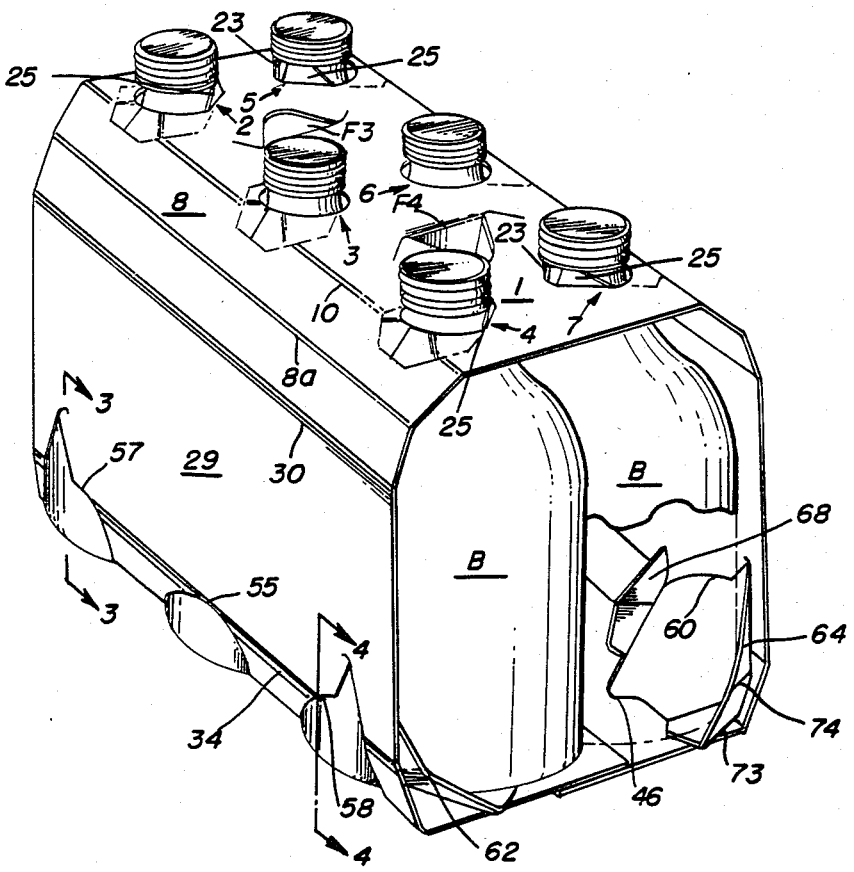
FIG. 1 is a perspective view of a set up carrier which incorporates features of this invention.
Figure 4:
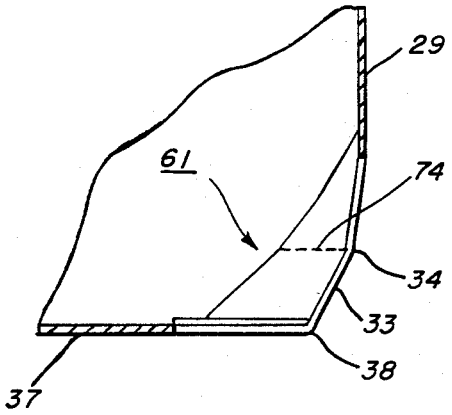
FIG. 4 is an enlarged fragmentary view taken along the line 4—4 in FIG. 3.
Figure 3:
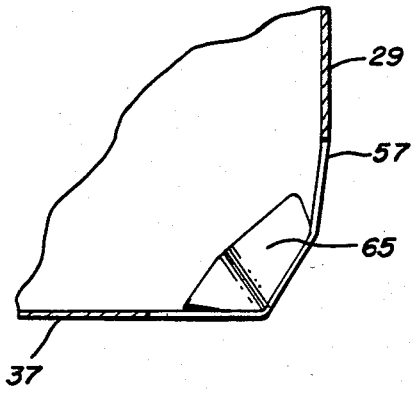

In order to form a package such as is shown in FIG. 1 from the blank such as is shown in FIG. 2, a blank is simply lowered from above onto the package in such manner that the bottle necks enter the bottle neck receiving apertures 2-7. Thereafter the side walls 29 and 31 and the associated sloping shoulder panels 8 and 9 and lap panels 37 and 39 are folded downwardly. Suitable machine elements enter the apertures 57-60 and manipulate the flaps 61-69 inwardly of the wrapper and so as to provide space between each pair of flaps such as 61 and 65 for receiving the heels of adjacent bottles as the side walls 29 and 31 are folded into close proximity with the bottle group and so as to cause the lap panel 37 to swing under the bottle group. Simultaneously the lap panel 39 is folded underneath lap panel 37. Thereafter the blank is tightened and locked as previously explained.

The bottle engaging carton reinforcing flaps 61-68 are manipulated by machine elements such as described in United States patent application Ser. No. 636831 filed Aug. 1, 1984. Also the carton is manipulated from a hopper onto the package so as to cause the bottle neck receiving apertures 2-7 to envelop the bottle necks by suitable mechanism disclosed and claimed in U.S. patent application Ser. No. 636830 filed August 1, 1984.

INDUSTRIAL APPLICABILITY

This invention is particularly well suited for packaging bottles in a wraparound carrier primarily because of the bottle engaging carrier reinforcing flaps which not only enhance bottle retention against dislodgment through the open ends of the wrapper but these flaps also significantly increase the mechanical strength of the wrapper at critical points such as at the lower corners of the wrapper.

I claim:

1. A bottle carrier of the wrap around type having top, bottom and side walls interconnected to form a tubular open ended structure wherein a sloping heel panel is interconnected with each side wall along a fold line and with an associated bottom lap panel along a fold line and wherein bottle heel receiving apertures are formed in each sloping heel panel which extend into the associated side wall and lap panel and wherein the improvement comprises combination bottle engaging and carrier reinforcing flaps foldably joined respectively along the outer edges of the bottle heel receiving apertures which are disposed immediately adjacent the open ends of the carrier, each bottle engaging and carrier reinforcing flap extending across the associated sloping heel panel and into the associated side wall and lap panel and having a fold line formed therein one end of which coincides with the fold line between the associated sloping heel panel and the associated lap panel and which is angularly disposed to said fold line and which is disposed in a plane which is substantially parallel with the inner surface of the associated lap panel.

2. A bottle carrier according to claim 1 wherein a second fold line is formed in each of said bottle engaging and carrier reinforcing flaps and wherein an end of each of said second fold lines coincides with the fold line between the associated side wall and sloping heel panel.

3. A bottle carrier according to claim 1 wherein a second bottle engaging carrier reinforcing flap is foldably joined along the inner edge of each bottle heel receiving aperture which is disposed immediately adjacent the open ends of the carrier.

4. A bottle carrier according to claim 3 wherein a fold line is formed in each of said second bottle engaging carrier reinforcing flaps one end of which coincides with the fold line between the associated sloping heel panel and the associated lap panel.

5. A bottle carrier according to claim 1 wherein each bottle engaging and carrier reinforcing flap is foldably joined to the outer edge of the associated bottle heel receiving aperture along a fold line comprising two angularly related parts.

6. A bottle carrier according to claim 5 wherein said angularly related parts intersect at the fold line between the associated sloping heel panel and the associated lap panel.

7. A bottle carrier of the wrap around type having top, bottom and side walls interconnected to form a tubular open ended structure wherein a sloping heel panel is interconnected with each side wall along a fold line and with an associated bottom lap panel along a fold line and wherein bottle heel receiving apertures are formed in each sloping heel panel which extend into the associated side wall and lap panel and wherein the improvement comprises combination bottle engaging and carrier reinforcing flaps foldably joned respectively along the outer edges of the bottle heel receiving apertures which are disposed immediately adjacent the open ends of the carrier, each bottle engaging and carrier reinforcing flap having a fold line formed therein one end of which coincides with the fold line between the associated sloping heel panel and the associated lap panel and which is disposed in a plane which is substantially parallel with the inner surface of the associated lap panel, and a second fold line formed in each of said bottle engaging and carrier reinforcing flaps and wherein an end of each of said second fold lines coincides with the fold line between the associated side wall and sloping heel panel.

8. A bottle carrier according to claim 7 wherein the fold lines in each of said bottle engaging and carrier reinforcing flaps are substantially parallel with each other.

* * * * *